US005587572A

United States Patent [19]

Kirby

[11] Patent Number: 5,587,572

[45] Date of Patent: Dec. 24, 1996

[54] BATCH COUNTER

[75] Inventor: John Kirby, South Devon, England

[73] Assignee: Kirby Devon Limited, England

[21] Appl. No.: 380,833

[22] Filed: Jan. 30, 1995

Related U.S. Application Data

[63] Continuation-in-part of Ser. No. 220,639, Mar. 31, 1994, abandoned.

[30] Foreign Application Priority Data

Apr. 23, 1993 [GB] United Kingdom ..... 9308506
Oct. 6, 1994 [GB] United Kingdom ..... 9420173

[51] Int. Cl.[6] ..... B61L 1/16

[52] U.S. Cl. ..... 235/98 R

[58] Field of Search ..... 235/98 R, 98 C, 235/98 A, 98 B

[56] References Cited

U.S. PATENT DOCUMENTS 2,059,398 11/1936 Roemer ..... 235/98 R
2,523,517 9/1950 Potter ..... 235/98 R
2,679,312 5/1954 Dean ..... 235/98 R
3,170,627 2/1965 Pearson et al. ..... 235/98 R
3,782,590 1/1974 Apfel .

FOREIGN PATENT DOCUMENTS 0257773 3/1988 European Pat. Off. .
1121032 7/1968 United Kingdom .

*Primary Examiner*—Cassandra C. Spyrou
*Attorney, Agent, or Firm*—Renner, Otto, Boisselle & Sklar, P.L.L.

[57] ABSTRACT

There is disclosed a batch counter for tablets and tablet-like items comprising a hopper with a wide bottom opening for a supply of the items to be counted. A channel member is adapted to channel the items from the hopper to a counter device so as to pass in single file and spaced apart at the counter device so that the counter device can count the passage of individual items from the hopper. The channel member comprises a lightweight, vibratory, V-section guide channel resiliently suspended, downwardly inclined towards the counter device, beneath the bottom opening and adjusted at critical inclination for the flow of the items.

20 Claims, 3 Drawing Sheets

BATCH COUNTER

This is a continuation-in-part of application Ser. No. 08/220,639 filed on Mar. 31, 1994, now abandoned.

This invention relates to a batch counter such as may be used for counting pharmaceutical tablets and tablet-like items such as nuts and bolts, or electronic devices such as transistors and capacitors or indeed any item that can be arranged to run from a hopper supply discretely down a slope.

Particularly for pharmaceutical tablets, there is a requirement for batching into bottles, say, of fifty or a hundred tablets automatically and without the need for tiresome manual counting. Batch counter machines are available but have numerous drawbacks, mainly involving price and complexity.

One problem lies in the proper regulation of the outflow of items from a hopper. The bottom opening of the hopper must be of a certain size, in relation to the size of the items being counted, such that arcing or bridging of items over the bottom opening does not occur. This, however, leads to a fast outflow, which results in difficulties in the counting device resolving individual items, leading to miscounts.

A batch counter, particularly for pharmaceutical tablets, needs to be versatile, to count tablets of different sizes, weights and surface finishes, and so the optimum bottom opening aperture cannot be provided for each kind or size of tablet. An adjustable bottom opening could be provided—an iris-type shutter say—but there would then be the problem of optimally adjusting the aperture. Bridging or arcing is a phenomenon that can happen but once in a while, though when it happens it is of course very troublesome. The setting of a bottom opening aperture cannot be easily done on a trial and error basis if the error—the tendency to arcing or bridging—may not manifest itself until after several hours of operation.

The complexity of conventional tablet counters often, too, makes them difficult to clean and particularly to sterilize—more particularly to sterilize under such conditions as are now demanded by licensing authorities to ensure destruction, for example, of HIV.

The present invention provides a batch counter that addresses these problems.

The invention comprises a batch counter for tablets and tablet-like items comprising a hopper with a wide bottom opening for a supply of the items to be counted, a counter device adapted to count the passage of individual items from the hopper, and channel means adapted to channel the items from the hopper to the counter device so as to pass in single file and spaced apart at the counter, the channel means comprising a lightweight, vibratory, V-section guide channel resiliently suspended, downwardly inclined towards the counter device, beneath said bottom opening and adjusted at critical inclination for the flow of items.

The inclination of the guide channel may be adjustable. The inclination of the guide channel may be dependent on the disposition of the hopper and the batch counter may then comprise hopper adjustment means adjusting the disposition of the hopper and the inclination of the guide channel.

The batch counter may comprise a damming arrangement associated with the guide channel, which may comprise a damming plate swingably suspended above the channel guide—the damming plate may be suspended from the hopper, and may be adjustable or selectable for weight. The damming plate may have an inverted V-notch aligned with the point of the V-section guide channel.

The guide channel may be suspended by elastic suspenders from the hopper. The hopper and the guide channel may have hooks and the guide channel may then be suspended by its hooks by elastic loops from the hooks of the hopper.

The guide channel may be attached to a vibrator, which may comprise an electromagnet which may be energised with an intermittent current or with a chopped alternating current, and the vibration amplitude may be variable by adjusting the chopping of the alternating current.

The guide channel may deliver the items into a second inclined guide channel, which may comprise a tube and which may be more steeply inclined than the V-section guide channel.

The counter may comprise a flap directing items to receptacles and flap positioning means repositioning the flap after a predetermined item count. The flap may direct items into one or the other leg of a bifurcated conduit, which may have bottom openings above a ledge for receptacles for the items.

The counter device may comprise a photoelectric device.

The channel means may be made readily removable for sterilization.

One embodiment of a batch counter according to the invention will now be described with reference to the accompanying drawings, in which.

The drawings illustrate a batch counter for tablets and tablet like items comprising a hopper 11 with a wide bottom opening 12 for a supply of the items to be counted.

A tablet counter as may be used industrially will be larger than one that may be used in a dispensary, but both will work on the same principle and be generally similar. A dispensary batch counter may be required to count, say, fifty tablets at a time into bottles and its hopper adapted to hold from one to several thousand tablets.

The bottom opening 12 is wide enough to avoid arcing or bridging which can happen when the opening dimension is around three times or less the diameter of the tablets—this depends however on the density and the surface texture of the tablets. Generally speaking, for use with the widest possible variety of tablets, the bottom opening 12 will be dimensioned having regard to the largest tablets likely to be encountered, and a square opening of size 100 mm is a preferred size. This will apply equally well to larger, industrial counters, of course.

That dimension of opening, of course, means that if no restriction were imposed, the tablets would simply flood out of the hopper 11; the measures to be described below regulate the outflow so that it is countable.

Figure 3:
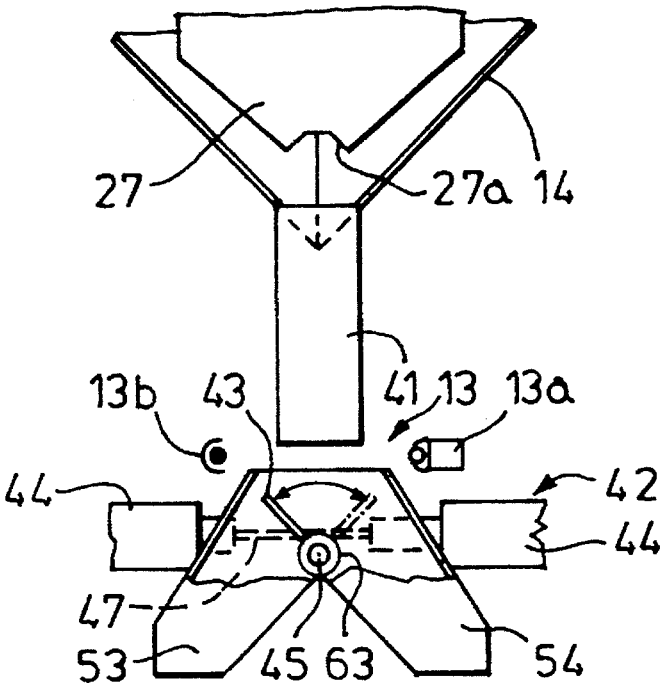
FIG. 3 is a front elevation to a larger scale of a part omitted from FIG. 2.
Figure 4:
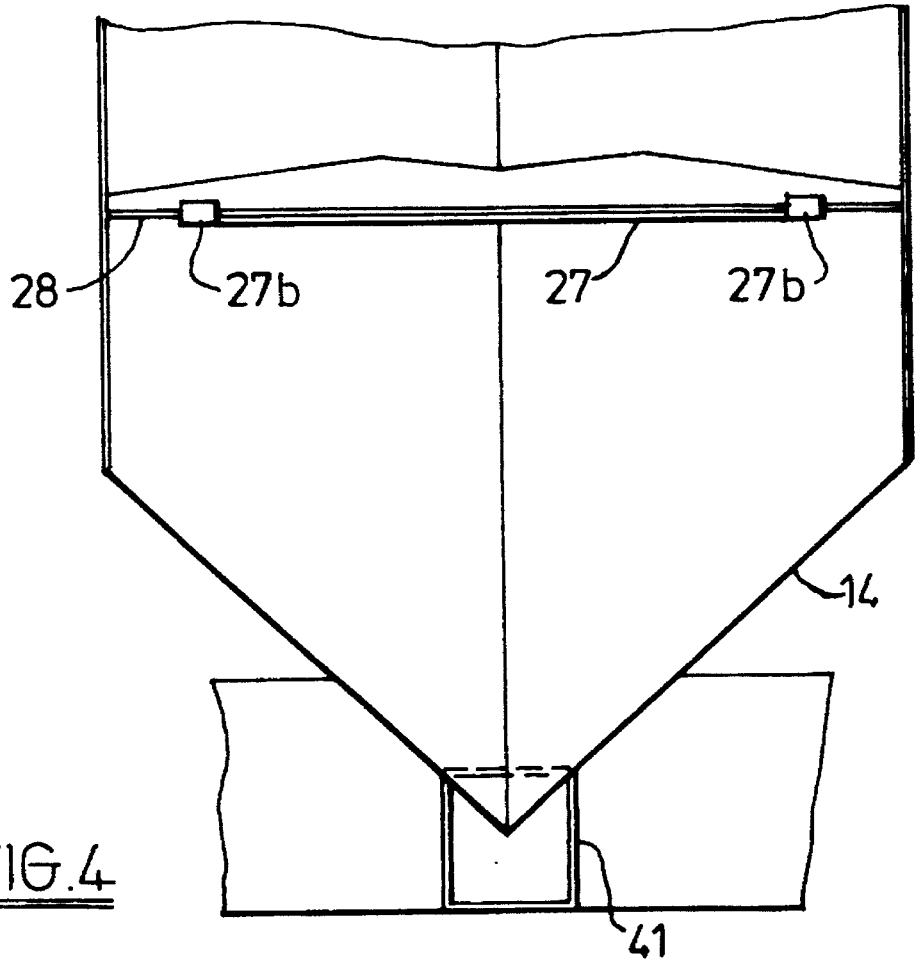
FIG. 4 is a plan view on Arrow 4 of FIG. 1 to a larger scale.

The counter comprises a counter device 13 (FIG. 3) in the form of a lamp 13*a* and photocell 13*b* arrangement, the photocell 13*b* registering the passage of individual tablets. Clearly, miscounting would arise if the tablets passed the photocell 13*b* in aggregations of two or more with no intervening space, and it is desirable therefore to ensure as far as possible that the tablets are spaced apart by the time they reach the counter device 13.

This is achieved by channel member 14 adapted to channel the tablets from the hopper 11 to the device 13 so as to pass in single file and spaced apart at the counter. The channel member 14 comprises a lightweight, vibrator, V-section guide channel resiliently suspended, downwardly inclined towards the counter device 13, beneath said bottom opening 12 and adjusted at critical inclination for the flow of tablets.

By critical inclination is meant the inclination at which a tablet just fails to slide down the channel 14 under gravity. It is clearly different for different tablets. A dedicated tablet counter in an industrial operation can of course be constructed so that the channel 14 is at the critical inclination appropriate to the tablet for which the counter is to be used. Generally speaking, however, it will be desired to provide adjustment for the channel 14 inclination to accommodate a variety of tablets. The correct adjustment is easily determined by placing a tablet on the shallowly inclined channel and tipping the channel until the tablet begins to slide, then backing off slightly and checking that the tablet does not slide at the backed-off inclination.

Since the guide channel 14 is located directly beneath the hopper 11, it is convenient to suspend it from the hopper. As a result, its inclination will depend on the disposition of the hopper 11 and a hopper adjustment mechanism 15 is provided in the form of an archimedian screw 15 on a lug 17 of the hopper 11 which screw 15 is mounted at 21 at the rear of the body 22 of the counter. The hopper 11 is mounted to the front of the body 22 by struts 23 pivoted on lugs 24 and clampable thereon by wing nuts 25. The screw 15 arrangement could of course be motor driven.

It will be appreciated that the hopper 11 is not only readily adjusted for tilt of the channel 14 but also readily removable for cleaning and for sterilization in an autoclave.

Clearly, the adjustment of the channel 14 to critical inclination does not guarantee that tablets dropping through the bottom aperture 12 and subject to the pressure of the "head" of tablets in the hopper 11 will not move en masse under gravity down the channel 14 and to provide further control, a damming arrangement 26 is associated with the guide channel 14. The damming arrangement 26 comprises a damming plate 27 swingingly suspended above the channel guide 14. The damming plate 27 is suspended by a hook-like formation **27*b* on a second damming plate 28** fixed to the hopper and is adjustable or selectable for weight—substitute or additional plates or weights can be used to vary the damming effect of the damming arrangement.

The damming plate 27 is shaped to conform to the contour of the channel 14 but is provided with an inverted V-notch **27*a* aligned with the point of the V-section guide channel 14—this forces tablets to flow essentially only down the middle of the channel 14 after being released by the damming plate 27**.

The guide channel 14 is suspended by elastic suspenders 29—suitably sized O-ring seals or other elastic loops are ideal—from hooks 31 fixed to the hopper 11. The channel 14 hangs on the suspenders 29 by its own hooks 32.

Figure 1:
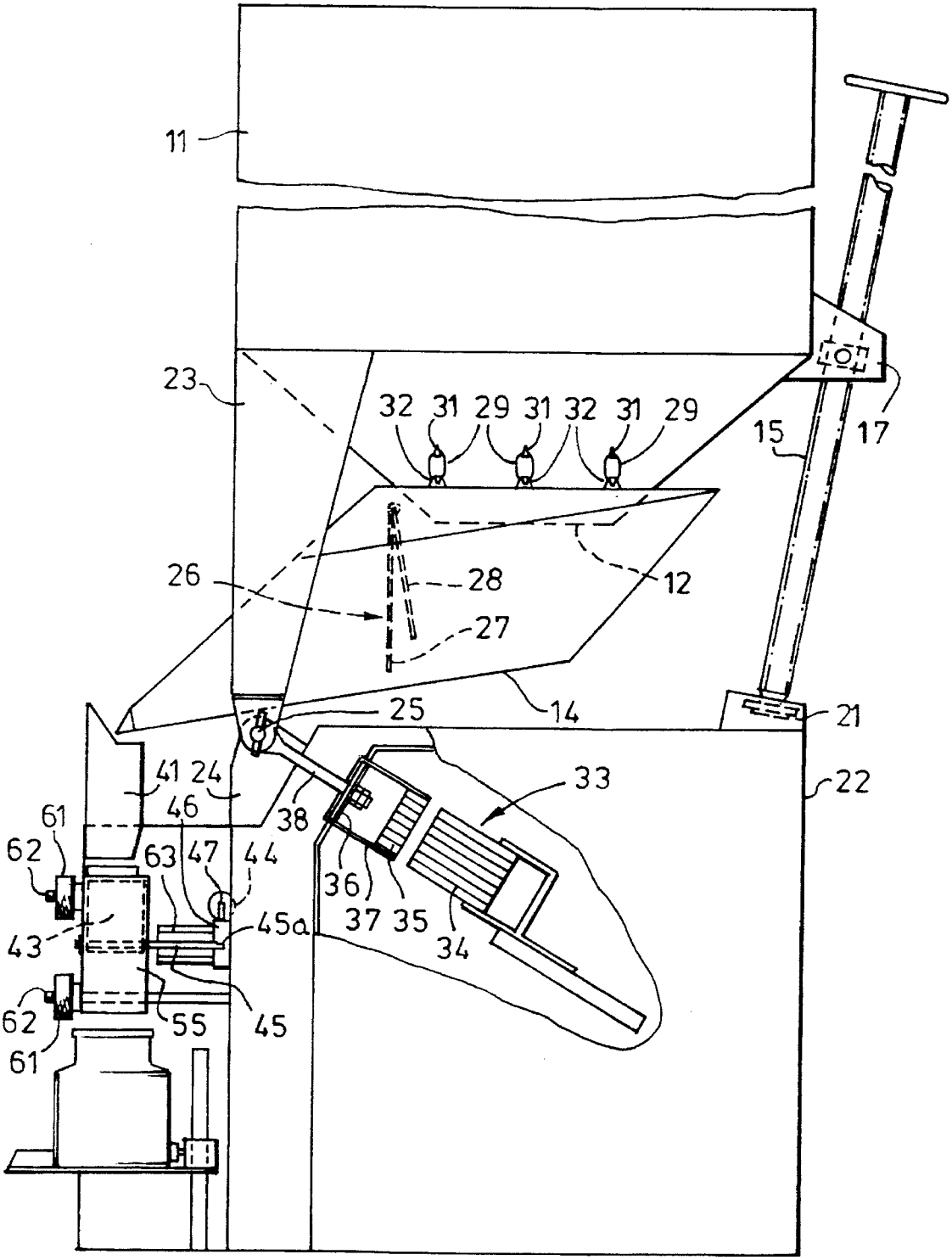
FIG. 1 is a side elevation of the counter.
Figure 2:
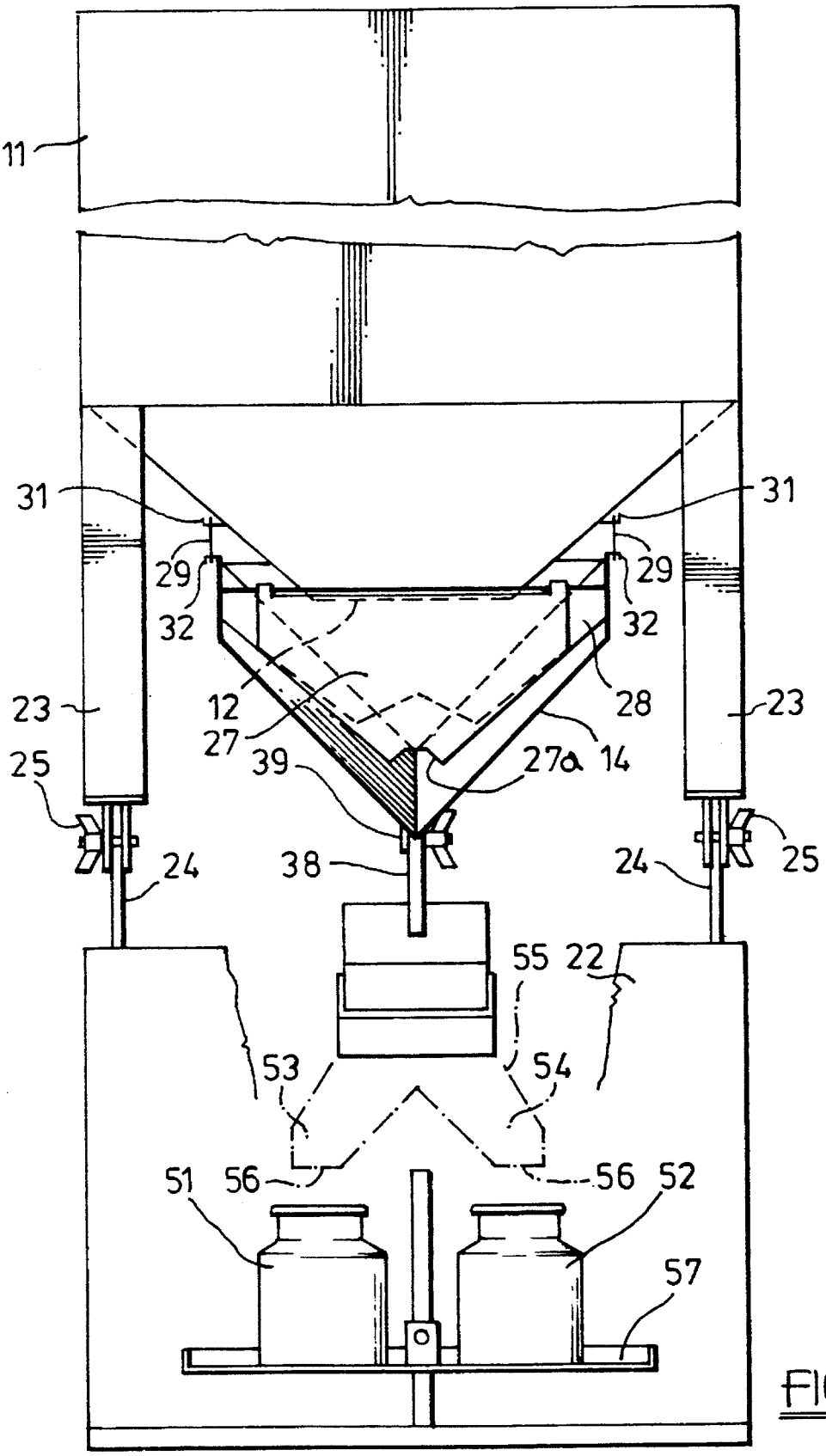
FIG. 2 is a part cut-away front elevation of the counter of FIG. 1.

The guide channel 14 is attached to a vibrator 33 which comprises an electromagnet 34 supplied with an intermittent or oscillating current which is mounted in the body 22 of the counter and which acts on an armature 35 which in turn is attached to the middle of a springy strip 36 by a yoke 37. The strip 36—which may be of springy metal or a stiff plastics or fibreglass material such as is used for printed circuit boards—is mounted by its ends in the body 22 and has a tie 38 extending from its middle section to a lug 39 on the channel 14 (FIG. 2).

The wing nuts 25 and lug 39 are in line, which allows the hopper 11 to be pivoted about the axis defined by the wing nuts 25 and the lug 39 so that the archimedian screw 15 is the only adjustment means necessary for altering the inclination of the guide channel 14 to speed up or retard the flow of tablets.

Generally speaking, vibration will release a tablet, which is resting on the channel at critical inclination, to move down the incline under gravity and likewise vibration will controlledly release a dammed-up pile of tablets on the critically inclined channel 14 to flow one-by-one and in Indian file from beneath the V-notch **27*a*. Adjustment to the rate at which the tablets are thus released may be had by adjusting the amplitude of the vibration. The electromagnet 34** may be fed with chopped alternating current (e.g. chopped single-phase mains current) which can be varied by for example a conventional triac motor controller.

The guide channel 14 delivers the tablets into a second guide channel 41 which in fact comprises a tube. The diameter of the tube will naturally be greater than the maximum diameter of tablets with which the counter is to be used. The tube 41 is more steeply inclined than the V-section guide channel 14. The tablets, already in Indian file and separated to at least some extent out of the V-section guide channel 14, will tend to increase their spatial separation because of the steeper inclination and the increased acceleration resulting therefrom.

The photocell **13*b* emits a signal pulse with the passage of each tablet and this is input to an up- or down-counter device that is pre-set with the required batch count and which, on attainment of said preset count, emits a control pulse to a solenoid arrangement 42 which flips a diverter plate or flap 43 so as to transfer the filling operation from one bottle 51 to a second bottle 52. The solenoid arrangement 42 comprises a solenoid 44 disposed either side of the flap 43, which is mounted on a horizontal spindle 45 having a flat end 45*a* keying into a slot in a rocker 46 pivoted by a rod 47 which is pulled between the solenoids 44—the flap 43 is stable in its end positions, so pulsing the solenoids 43** will suffice—they do not need to be permanently energised, which saves power and reduces the cooling requirement.

The diverter plate or flap 43 directs the tablets into one or other leg 53,54 of a bifurcated conduit 55 which has bottom openings 56 above a ledge 57 for the bottles 51,52.

The conduit 55 and the inclined tube 41 comprise a unit which can be removed for cleaning and sterilizing by unscrewing nuts 61 from end-threaded spigots 62. The flap 43 can then also be removed simply by pulling it out of its bearing 63—a nylon or like bush.

The counter can be designed with appropriate modification to be suitable for counting or batching small items other than pharmaceutical tablets and may indeed be adapted for batching engineering items such as washers, nuts and screws, or for electronic components such as transistors and capacitors, food items such as sweets and indeed anything which can be made to flow as discrete, countable objects.

Whilst the counter described and illustrated is manually set up to best adjustment for satisfactory operation with the particular tablets or other items being counted, it is possible to introduce an automatic control arrangement with for example a memory for the required settings for different items and/or a feed back arrangement that adjusts the tilt of the guide channel and/or the amplitude of the vibration applied to it and/or the damming effect of the damming arrangement, which latter arrangement may include loading other than gravitational, for example by an adjustable magnet or electromagnet or by a motorised spring loading arrangement. A sensing arrangement may detect the rate of counting and the control arrangement make adjustments to one or other of the operating variables to seek to maximise the rate of counting. As more than one variable is involved, the control arrangement may with advantage include a neural network.

And for continuous unattended operations, a conveyor may carry empty bottles past the arrangement under the control of the control arrangement.

I claim:

1. A batch counter for tablets and tablet-like items comprising a hopper with a wide bottom opening for passage of a supply of the items to be counted, a counter device for counting the passage of the items from the hopper, and channel means for channeling the items from the hopper to the counter device so as to pass in single file and spaced apart at the counter device, the channel means comprising a lightweight, vibratory, V-section guide channel resiliently suspended, downwardly inclined towards the counter device, beneath the bottom opening of the hopper and adjusted at critical inclination for flow of the items, and a damming plate swingably suspended above the guide channel.

2. A counter according to claim 1, comprising means for adjusting the inclination of the guide channel.

3. A counter according to claim 1, the inclination of the guide channel depending on a disposition of the hopper, and hopper adjustment means for adjusting the disposition of the hopper and the inclination of the guide channel.

4. A counter according to claim 1, in which the damming plate is suspended from the hopper.

5. A counter according to claim 1, comprising means for making the damming plate adjustable or selectable for weight.

6. A counter according to claim 1, in which the damming plate has an inverted V-notch aligned with a point of the V-section guide channel.

7. A counter according to claim 1, comprising elastic suspenders for supporting the guide channel from the hopper.

8. A counter according to claim 7, the hopper and guide channel having hooks, the elastic suspenders comprising elastic loops suspended from the hooks of the hopper, and the hooks of the guide channel suspended from the elastic loops.

9. A counter according to claim 1, comprising a vibrator attached to the guide channel for vibrating the guide channel.

10. A counter according to claim 9, in which the vibrator comprises an electromagnet.

11. A counter according to claim 10, comprising means for energizing the electromagnet with a chopped alternating current.

12. A counter according to claim 11, comprising means for adjusting the chopped alternating current to vary vibration amplitude of the vibrator.

13. A counter according to claim 11, comprising a second inclined guide channel to which the items are delivered from the guide channel.

14. A counter according to claim 13, in which the second inclined guide channel comprises a tube.

15. A counter according to claim 13, in which the second inclined guide channel is more steeply inclined than the guide channel.

16. A counter according to claim 1, comprising receptacles for receiving the items, a flap for directing the items to one of the receptacles, and flap positioning means for repositioning the flap after a predetermined count of the items for redirecting the items to another of the receptacles.

17. A counter according to claim 16, comprising a bifurcated conduit having two legs, the flap being positionable by the flap positioning means to direct the items into either one of the two legs of the bifurcated conduit.

18. A counter according to claim 17, comprising a ledge for the receptacles for the items, the bifurcated conduit having bottom openings above the ledge.

19. A counter according to claim 1, in which the counter device comprises a photoelectric device.

20. A counter according to claim 1, in which the channel means are readily detachable from the counter for sterilization.

* * * * *